US011492889B2

(12) United States Patent
Rojas et al.

(10) Patent No.: US 11,492,889 B2
(45) Date of Patent: Nov. 8, 2022

(54) ACTIVE OIL PHASE RECOVERY DEVICE FOR REMEDIATION WELLS

(71) Applicant: YPF TECNOLOGÍA S.A., Ciudad Autónoma de Buenos Aires (AR)

(72) Inventors: Graciela Rojas, Avellaneda Prov. de Buenos Aires (AR); María Elena Oneto, La Plata Pcia. de Buenos Aires (AR)

(73) Assignee: YPF TECNOLOGÍA S.A., Ciudad Autónoma de Buenos Aires (AR)

( * ) Notice: Subject to any disclaimer, the term of this patent is extended or adjusted under 35 U.S.C. 154(b) by 53 days.

(21) Appl. No.: 17/081,659

(22) Filed: Oct. 27, 2020

(65) Prior Publication Data

US 2021/0123336 A1 Apr. 29, 2021

Related U.S. Application Data

(60) Provisional application No. 62/926,772, filed on Oct. 28, 2019.

(51) Int. Cl.
*E21B 43/38* (2006.01)

(52) U.S. Cl.
CPC ..... *E21B 43/38* (2013.01)

(58) Field of Classification Search
CPC ..... E21B 43/34; E21B 43/35; E21B 43/38; E21B 43/385; E21B 43/40
See application file for complete search history.

(56) References Cited

U.S. PATENT DOCUMENTS

| | | | | |
|---|---|---|---|---|
| 3,667,608 | A | 6/1972 | Burroughs et al. | |
| 3,670,896 | A | 6/1972 | Hale, Jr. et al. | |
| 4,497,370 | A * | 2/1985 | Breslin | B01D 17/0214 166/372 |
| 4,998,585 | A * | 3/1991 | Newcomer | B01D 17/0214 210/776 |
| 5,326,458 | A * | 7/1994 | Johnson | B01D 17/0214 210/170.07 |
| 5,474,685 | A * | 12/1995 | Breslin | E21B 43/38 210/776 |
| 2020/0215459 | A1 | 7/2020 | Oneto et al. | |

FOREIGN PATENT DOCUMENTS

| | | | |
|---|---|---|---|
| EP | 2641642 | B1 | 9/2013 |
| WO | WO2019/155443 | A1 | 8/2019 |

* cited by examiner

*Primary Examiner* — David Carroll
(74) *Attorney, Agent, or Firm* — Muncy, Geissler, olds & Lowe, P.C.

(57) ABSTRACT

A device for separating an oil phase from an aqueous phase in a remediation well and conveying said separated oil phase to a tank at the surface, wherein said device comprises: a chamber comprising at least two hoses connected to an upper part of the chamber, the hoses being communicated with an interior of the chamber; an oil phase and aqueous phase separating filter, located in the upper part of the chamber and communicated with the interior of the chamber, the filter having a lid on an upper part of the filter; and a hollow float attached to a lower part of the chamber, the float comprising a ballast at a lower end, wherein the ballast comprises a centering body at a lower end.

19 Claims, 6 Drawing Sheets

ACTIVE OIL PHASE RECOVERY DEVICE FOR REMEDIATION WELLS

FIELD OF THE INVENTION

The present invention related to the field of devices for separating an oil phase from an aqueous phase in a remediation well. More specifically, the present invention is related to a device for separating an oil phase from an aqueous phase in a remediation well and conveying said separated oil phase into a tank at the surface.

BACKGROUND OF THE INVENTION

In the oil industry field, contamination of groundwater by oil phase represents an unwanted drawback due to its high environmental impact. The separation between an oil phase and an aqueous phase is a common feature in several remediation processes of groundwater contaminated with oil phase.

The separation and extraction of aqueous and oil phases from a mixture thereof can be based on hydrophobicity mechanisms. There are devices known in the prior art that allow the both the separation and recovery of oil phase from aqueous phase, in addition to cleaning groundwater, but none of them allow to carry out such tasks in a simple way. Also, none of these devices can adequately adapt to water table level variation in remediation wells.

Consequently, there is a need to provide a device that allows the separation of the oil phase in contaminated groundwater and its recovery in a simple manner so as to clean groundwater, and that allows to adapt to water table level variation without affecting the functionality of the device.

BRIEF DESCRIPTION OF THE INVENTION

It is an object of the present invention a device for separating an oil phase from an aqueous phase in a remediation well and conveying said separated oil phase to a tank at the surface, wherein said device comprises:

- a chamber comprising at least two hoses connected to an upper part of the chamber, the hoses being communicated with an interior of the chamber;
- an oil phase and aqueous phase separating filter, located in the upper part of the chamber and communicated with the interior of the chamber, the filter having a lid on an upper part of the filter; and
- a hollow float attached to a lower part of the chamber, the float comprising a ballast at a lower end, wherein the ballast comprises a centering body at a lower end.

In one embodiment of the present invention, the device is suitable for wells ranging from 2" to 8" in diameter. In a preferred embodiment of the present invention, the device is suitable for wells ranging from 4" and 6" in diameter.

In one embodiment of the present invention, the chamber comprises two hoses connected in fluid communication with the interior of the chamber.

In a preferred embodiment of the present invention, one hose is connected to a compressed air source to provide compressed air to the interior of the chamber and the other hose is connected to a tank on the outside of the remediation well and allows the oil phase to exit the interior of the chamber.

In one embodiment of the present invention, the minimum pressure of the compressed air is 0.5

$$\frac{kgf}{cm^2}.$$

In one embodiment of the present invention, the separating filter comprises a metal mesh, preferably made of brass or stainless steel.

In one embodiment of the present invention, the metal mesh is coated with a hydrophobic substance.

In one embodiment of the present invention, each one of the chamber, the filter and the float comprises a polygonal cross section, preferably with curved sides, more preferably a cross section substantially similar to a Reuleaux triangle.

In one embodiment of the present invention, each one of the chamber, the filter and the float comprises a circular cross section.

In one embodiment of the present invention, the chamber has an increasing cross section in a downward direction with respect to its longitudinal axis.

In one embodiment of the present invention, the filter has a decreasing cross section in a downward direction with respect to its longitudinal axis.

In one embodiment of the present invention, the float has a decreasing cross section in a downward direction with respect to its longitudinal axis.

In a preferred embodiment of the present invention, the separating filter has a substantially conical shape.

In a preferred embodiment of the present invention, the float has a substantially conical shape.

In one embodiment of the present invention, the filter is communicated with the interior of the chamber through a check valve allowing the passage of the oil phase from the filter to the interior of the chamber and preventing the passage of the oil phase from the interior of the chamber to the filter.

In one embodiment of the present invention, the float is attached to the chamber by means of a threaded joint.

In one embodiment of the present invention, the at least two hoses connected to the upper part of the chamber form a helicoid or spiral to ensure the correct elongation of the hoses.

In one embodiment of the present invention, the at least two hoses are at least partly welded together.

In one embodiment of the present invention, the at least two hoses are made of an oil phase resistant polymer, preferably selected from the group comprising polyvinyl chloride, polyurethane and polydimethylsiloxane.

DETAILED DESCRIPTION OF THE INVENTION

The device of the present invention will be described below in detail with reference to FIGS. 1 to 5*b*, which illustrate an embodiment of the invention and the different elements thereof. Said Figures are only by way of example and should not be considered as limiting the invention.

In each one of the Figures the same numerical references are used to designate same elements of the device of the present invention.

For the purpose of the present invention, the expression "oil phase" refers to petroleum and/or the hydrocarbon derivatives thereof.

Figure 1A:
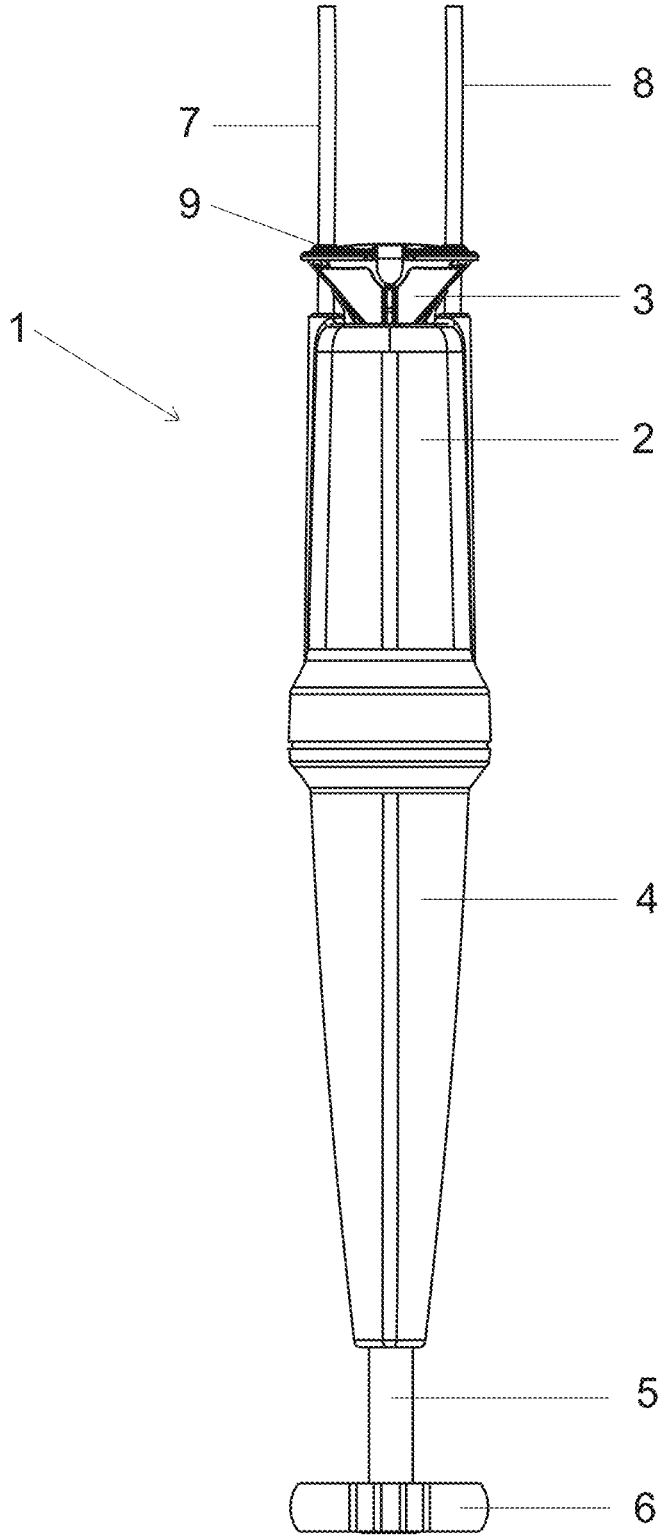
FIG. 1*a* shows a front view of the device of the present invention.
Figure 1B:
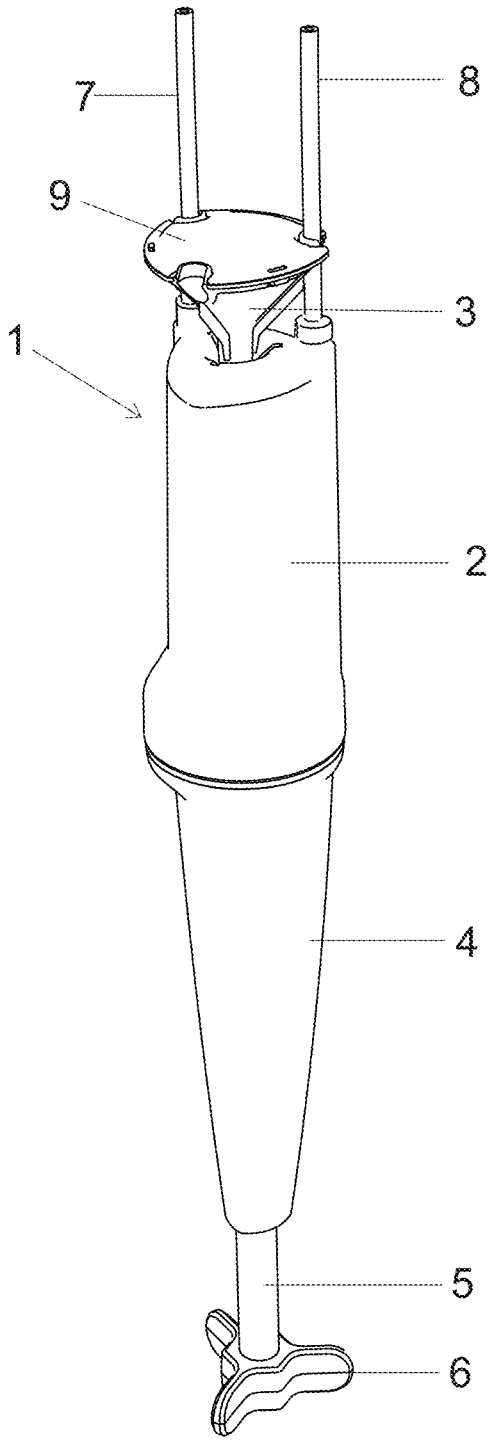
FIG. 1*b* shows a top perspective view of the device of the present invention.
Figure 1C:
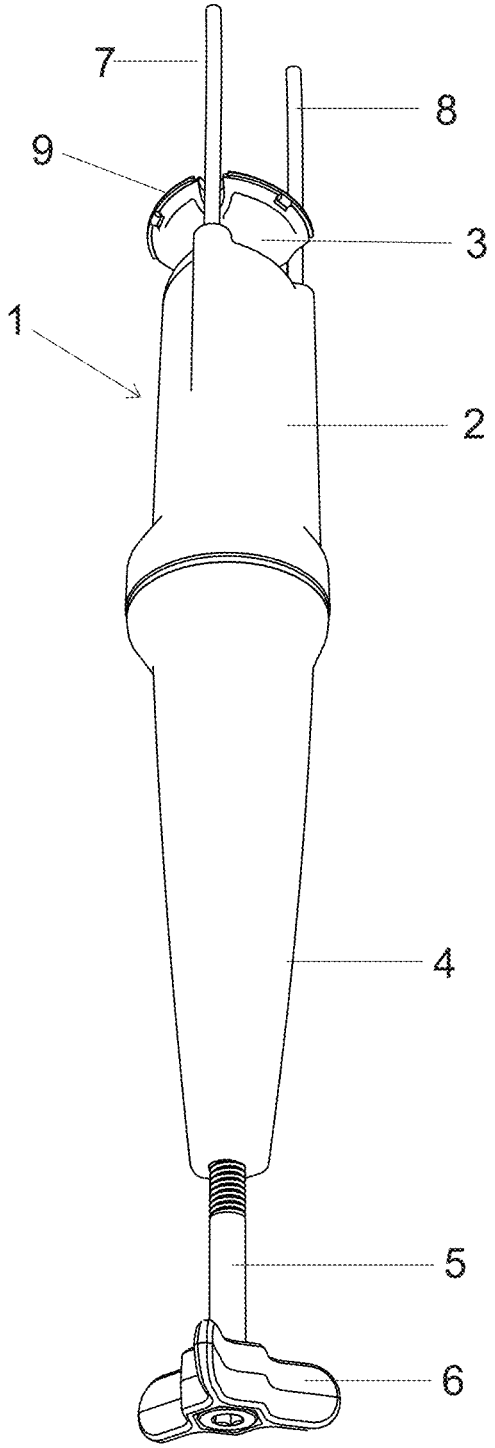
FIG. 1*c* shows a bottom perspective view of the device of the present invention.

Referring to FIGS. 1*a*, 1*b* and 1*c* a front view and top and bottom perspective views, respectively, can be seen of an embodiment of device 1 for remediation wells of the present invention comprising mainly a chamber 2, a separating filter 3, a hollow float 4, a ballast 5, a centering body 6, an inlet hose 7 and an outlet hose 8.

Filter 3 is made of a metal mesh, preferably brass or stainless steel, which is coated with a hydrophobic substance. Also, the filter 3 has a lid 9 in its upper part so that an inner volume of filter 3 is defined. This lid 9 prevents the entry of the aqueous phase into the inner volume of the filter 3 and of any material that could damage the metal mesh of the filter 3 and/or affect the filtering capacity and, consequently, the separation of an oil phase from an aqueous phase. In this way, the metal mesh will only allow the oil phase to enter the inner volume of the filter 3, thus achieving the recovery of the oil phase in addition to the cleaning of groundwater.

Once the oil phase has entered the inner volume of filter 3, the oil phase is conveyed through a conduit that extends from the bottom of filter 3 to chamber 2 where the oil phase will be accumulated and then conveyed to the surface.

Chamber 2, filter 3 and float 4 can each comprise a polygonal cross section, preferably with curved sides, and more preferably a cross section substantially similar to a Reuleaux triangle; or a circular cross section.

As can be seen in FIG. 1, chamber 2 has an increasing cross section in a downward direction with respect to its longitudinal axis. On the other hand, each one of filter 3 and float 4 have a decreasing cross section in a downward direction with respect to its longitudinal axis.

In an embodiment, each one of the separating filter 3 and the hollow float 4 can have a substantially conical shape.

The operating principle of the device 1 for remediation wells of the present invention is the injection of compressed air into chamber 2 through the inlet hose 7, which is connected to a compressed air source to provide compressed air inside chamber 2, so that the compressed air displaces the separated oil phase in chamber 2 and due to the injected pressure said separated oil phase is forced to exit through the outlet hose 8, which is connected to a tank outside the well, at the surface.

In this way, device 1 for remediation wells, when supplied with compressed air, allows the oil phase accumulated in chamber 2 to be conveyed through the outlet hose 8 and deposited in a tank located outside the well, at the surface.

To facilitate the identification of which hose corresponds to the inlet and which corresponds to the outlet, by way of example, the inlet hose 7 for compressed air injection can be an opaque hose, and the outlet hose 8 for oil phase conveyance can be a translucent hose.

Figure 2:
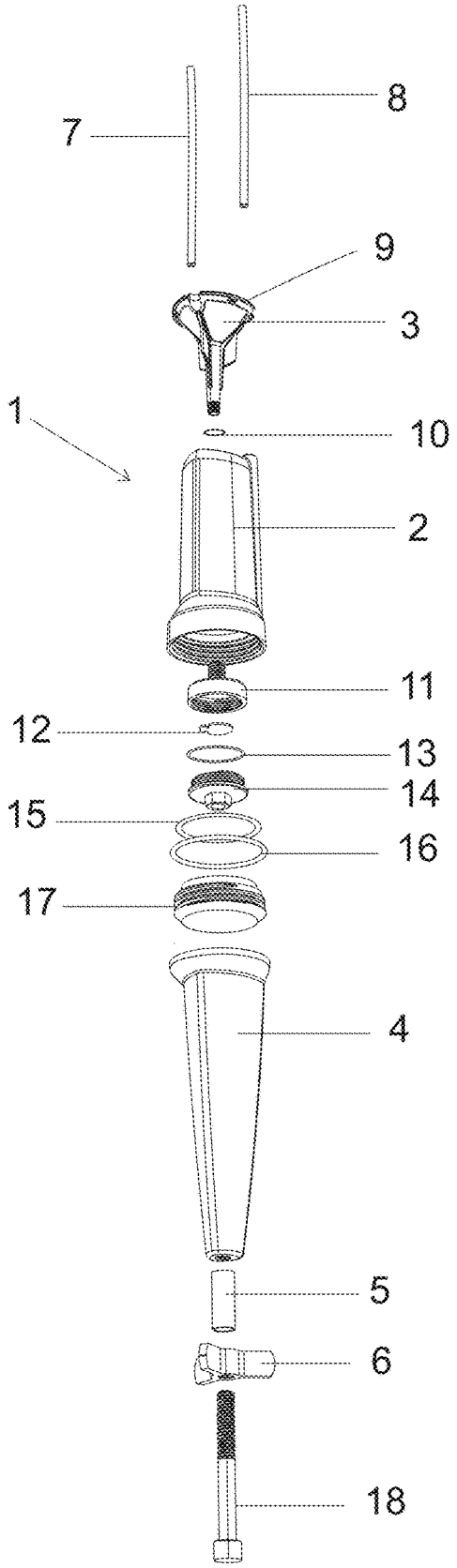
FIG. 2 shows a bottom perspective exploded view of the device of the present invention.

Referring to FIG. 2, it can be seen a bottom perspective exploded view of device 1 for remediation wells of the present invention comprising, in addition to the components cited above, a filter seal 10, a valve top portion 11, a membrane 12, a valve seal 13, a valve bottom portion 14, an upper valve seal 15, a lower valve seal 16, a threaded cover 17 of float 4 and a threaded pin 18.

Each of the seals are preferably toric joints, also known as O-rings, made of an elastic material, preferably rubber, in order to guarantee the liquid tightness of the different components.

The chamber 2 has a suitable geometry in its upper part and upper grooves that allow the coupling of filter 3 and guarantee the liquid tightness of this coupling by means of the filter seal 10. In this way, filter 3 can be easily replaced by another filter, in case of damage or deterioration, by uncoupling it from the upper grooves of chamber 2.

The chamber 2 has a check valve inside, comprising the valve top portion 11, the membrane 12, the valve seal 13, the valve bottom portion 14, the upper valve seal 15 and the lower valve seal 16. This check valve is screwed into the conduit extending from the bottom of the filter 3 via the valve top portion 11, wherein said conduit has a thread at its bottom end.

The check valve in the oil phase recovery stage allows the filtered product to pass through the metal mesh of the filter 3 to the chamber 2 and in the stage of oil phase conveyance to the tank at the surface, prevents the passage of the oil phase back to the filter 3, so as to ensure that only the oil phase conveys through the outlet hose 8.

Figure 3A:
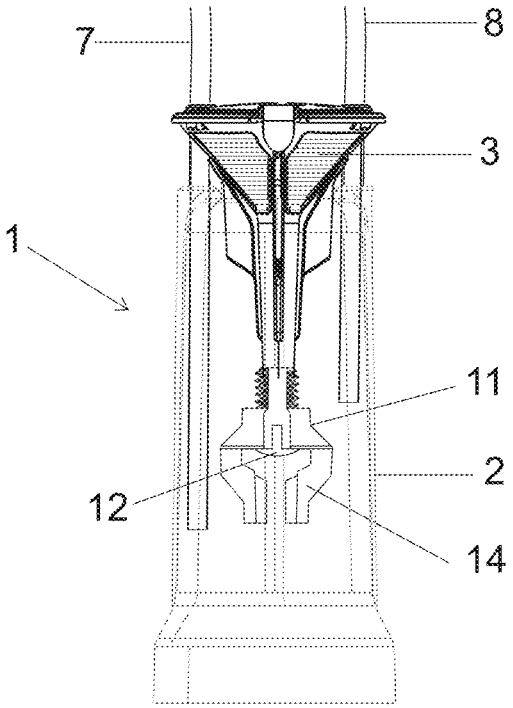
FIG. 3*a* shows a detailed view of the check valve of the chamber of the device of the present invention in closed position.
Figure 3B:
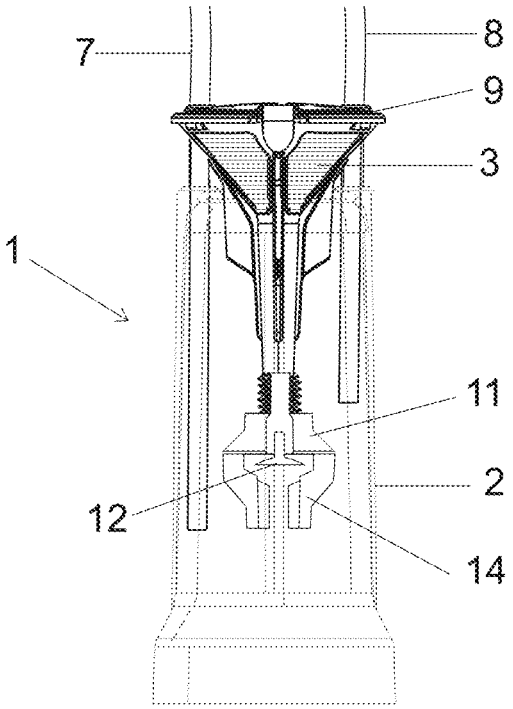
FIG. 3*b* shows a detailed view of the check valve of the chamber of the device of the present invention in open position.

The operation mode of the check valve can be seen in the detailed views shown in FIGS. 3*a* and 3*b*, in which the chamber 2 is transparently shown to facilitate understanding of the operation. In particular, in FIG. 3*a*, the check valve can be seen blocking the flow in an upward direction (illustrated in FIG. 3*a* by an arrow in the upward direction), i.e., the flow from chamber 2 to filter 3. This is achieved by means of membrane 12 which, in the stage of oil phase conveyance to the tank at the surface, contacts the valve top portion 11 due to the pressure in chamber 2 and, thus, prevents the oil phase passage to filter 3. On the other hand, FIG. 3*b* shows the check valve allowing flow in a downward direction (illustrated in FIG. 3*b* by an arrow in the downward direction), i.e., the flow from filter 3 to chamber 2. This is achieved by means of membrane 12 which, in the stage of oil phase recovery, once there is no longer pressure in chamber 2 and due to the weight of the oil phase above the membrane, the membrane detaches from the valve top portion 11 and, consequently, allows the passage of fluid from filter 3 to chamber 2.

In an alternative embodiment, the check valve, instead of comprising the membrane 12, comprises a small cylinder, preferably made of stainless steel, which fits the internal diameter of the valve and allows the oil phase to go up though the outlet hose 8 without returning to the filter 3.

Chamber 2 is connected by means of a thread to the threaded cover 17 of float 4. This cover 17 is heat-sealed to float 4. If the check valve should fail for any reason, it can be easily accessed for replacement by unscrewing chamber 2 from float 4.

The float 4 is a "buoy" type piece that due to the air inside it acts as a float in device 1 and stabilizes the weight generated by the hoses, the recovered oil phase and the set of pieces inside the chamber 2.

Figure 4:
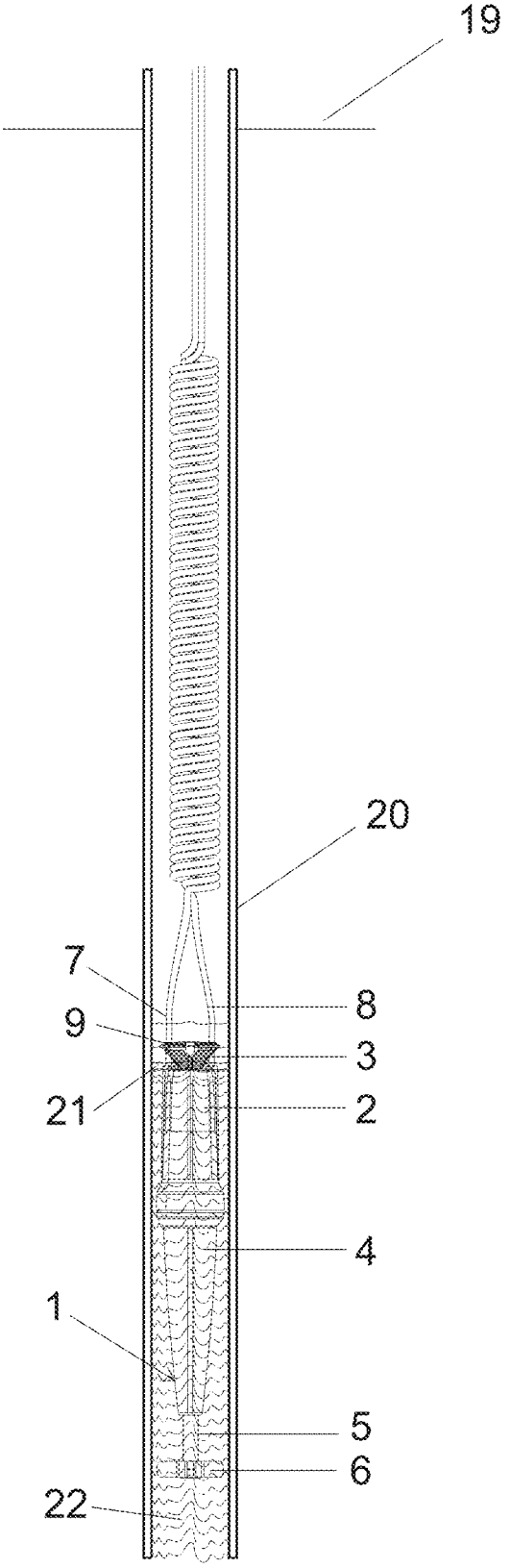
FIG. 4 shows a front view of the device of the present invention placed within a remediation well.

Referring to FIG. 4 it can be seen a front view of device 1 for remediation wells of the present invention installed in a remediation well. In said FIG. 4, in addition to components cited above, the surface 19, the casing 20, the oil phase 21 and the aqueous phase 22 can be seen.

It can be seen in FIG. 4 how the inlet hose 7 and the outlet hose 8, when moving away from chamber 2, form a helicoid or spiral to ensure the correct elongation of the hoses to respond to water table level variation. Also, in a preferred embodiment the inlet hose 7 and the outlet hose 8 are at least partly welded together outside of chamber 2. This ensures that the spiral always remains aligned and unobstructed.

The inlet hose 7 and outlet hose 8 are made of an oil phase resistant polymer, preferably selected from the group comprising polyvinyl chloride, polyurethane and polydimethylsiloxane.

At the time of installation, device 1 for remediation wells of the present invention must be stabilized, maintaining the waterline in the aqueous phase. The waterline is to be understood as the imaginary line separating the submerged part from the floating part. It is important to maintain such a line so as to ensure that the filter 3 is in a suitable position to allow the passage of the oil phase into the filter. This is achieved by using ballast 5 in case where the oil phase densities vary considerably.

In the event of water table level variation or fluctuation, filter 3 would come into contact with the aqueous phase and would resist the hydrostatic pressure of the aqueous phase column above it, thus preventing its permeation. Once the water table level returns to its normal values, the filter 3 emerges to the surface and the metal mesh comes back into contact with the oil phase, recovering its functionality.

In case the aqueous phase column was higher and the pressure made the metal mesh collapse enabling the aqueous phase to enter inside the filter 3, once the water table level returns to its normal values, i.e., the aqueous phase column decreases, the filter 3 emerges to the surface and the metal mesh makes contact again with the oil phase making the filter 3 continue with the oil phase filtration process.

It should be noted that device 1 can be installed in remediation wells ranging from 2" to 8" in diameter. Therefore, device 1 can be installed in wells whose diameters are, for example, 2", 4", 6" and 8", among others. These wells can be made in areas of treatment, distillation, refining or control of groundwater.

Once the device 1 is stabilized after installation, floating in the aqueous phase and with oil phase to recover, the device 1 starts operating, injecting compressed air to the inlet hose 7 and recovering oil phase, that is, hydrocarbons, through the outlet hose 8, in the tank at the surface.

Figure 5A:
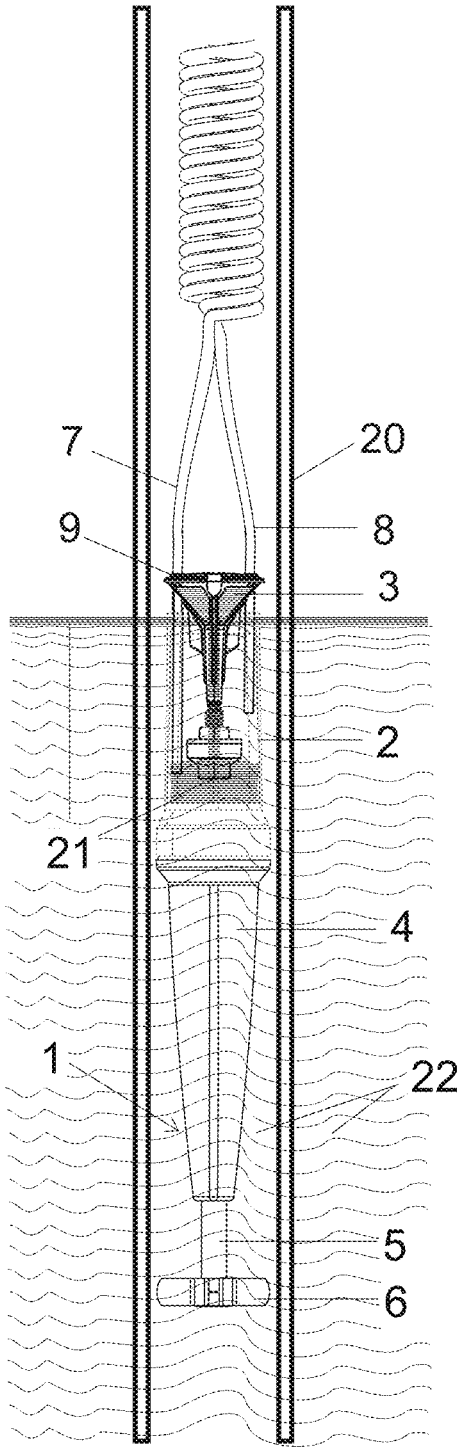
FIG. 5*a* shows a front view of the device of the present invention where the passage of the oil phase from the filter to the interior of the chamber is shown.
Figure 5B:
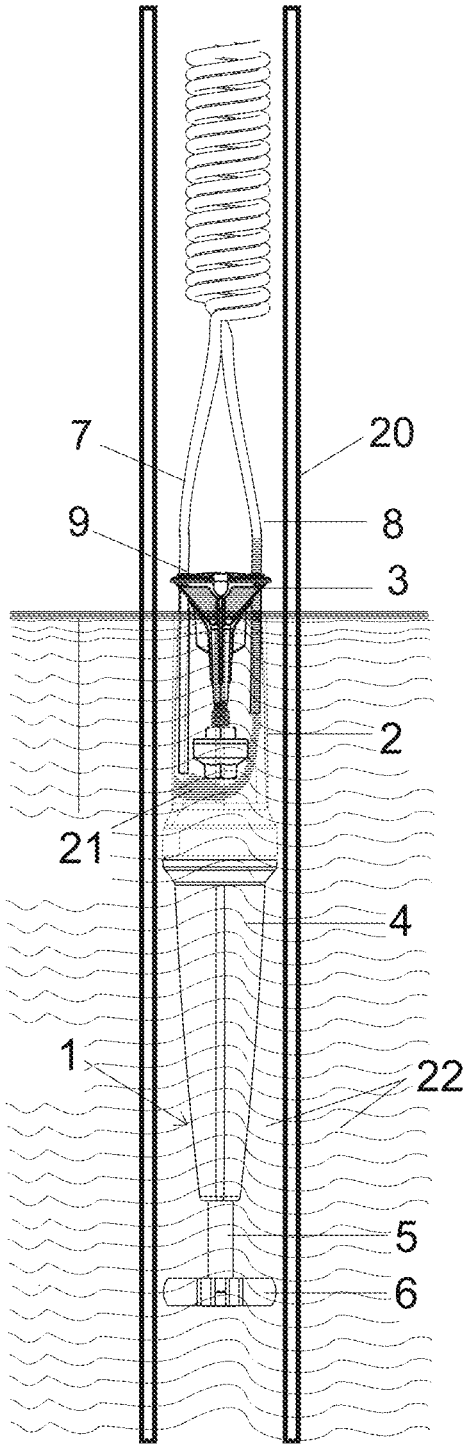
FIG. 5*b* shows a front view of the device of the present invention where it is shown how, by means of the injection of compressed air to the interior of the chamber through a hose, the exit of the oil phase is allowed through another hose.

FIGS. 5*a* and 5*b* show device 1 in operation, wherein chamber 2 is transparently shown to facilitate understanding of the operation of device 1. In particular, FIG. 5*a* shows how the oil phase 21 when entering the filter 3 passes though the conduit of the filter 3 to enter the chamber 2. At a given time, see FIG. 5*b*, compressed air is injected through the inlet hose 7 which makes the oil phase 21 exit the chamber 2 through the outlet hose 8. FIG. 5*b* also shows that, due to the check valve mentioned above, the passage of the oil phase 21 back to the filter 3 is prevented.

It should be noted that casing 20 has cross openings (not shown) through which the filter 3 recovers the oil phase 21 that is outside the casing 20 and conveys the oil phase 21 to the tank at the surface.

The tank located at the surface (not shown in the Figures) has a control and instrumentation system that senses the entry of filtered product, i.e. oil phase, into the surface tank and through a configurable mode, as appropriate, begins sending cycles of compressed air injection during a given amount of seconds and of rest during a given amount of seconds to allow the recovery of oil phase in chamber 2 to evacuate the new oil phase recovered in the next cycle. Thus, continuously, the initial operation configured will be repeated until for some reason the control system detects a change in the sensor located at the entrance of the tank at the surface. If this occurs, the operation mode will be changed automatically according to the sensing result. If the sensor detects air, it will modify the cycle operation mode by increasing the oil phase recovery time. If the sensor detects aqueous phase, it will stop the operation of device 1 and will report the problem for verification because the seals and/or the metal mesh may be damaged, thus allowing the passage of aqueous phase 22.

Finally, it should be noted that the minimum air pressure required to ensure the operation of the device is 0.5

$$\frac{kgf}{cm^2}$$

(approximately 0.5 bar), varying this pressure according to the depth of the phases inside the well. The compressed air is supplied from a source, as mentioned above, which can be the air line from the refineries, service stations or an external compressor and even a pressurized drum.

The invention claimed is:

1. A device for separating an oil phase from an aqueous phase in a remediation well and conveying said separated oil phase to a tank located outside of the remediation well, wherein said device comprises:

a chamber comprising at least two hoses connected to an upper part of the chamber, the hoses being in fluid communication with an interior of the chamber;

an oil phase and aqueous phase separating filter located in the upper part of the chamber, the filter being in fluid communication with the interior of the chamber and having a lid on an upper part of the filter; and a hollow float attached to a lower part of the chamber, the float comprising a ballast at a lower end thereof, wherein the ballast comprises a centering body at a lower end thereof, wherein each one of the chamber, the filter and the float comprises a polygonal cross section.

2. The device according to claim 1, wherein the chamber comprises two hoses connected in fluid communication with the interior of the chamber.

3. The device according to claim 2, wherein one hose is connected to a compressed air source to provide compressed air to the interior of the chamber, and the other hose is connected to the tank located outside of the remediation well and configured to allow the separated oil phase to exit the interior of the chamber.

4. The device according to claim 3, wherein the minimum pressure of the compressed air is 0.5

$$\frac{kgf}{cm^2}.$$

5. The device according to claim 1, wherein the separating filter comprises a metal mesh.

6. The device according to claim 5, wherein the metal mesh is coated with a hydrophobic substance.

7. The device according to claim 1, wherein the polygonal cross section has curved sides.

8. The device according to claim 1, wherein the polygonal cross section is a Reuleaux triangle.

9. The device according to claim 1, wherein the chamber has an increasing cross section in a downward direction with respect to its longitudinal axis.

10. The device according to claim 1, wherein the filter has a decreasing cross section in a downward direction with respect to its longitudinal axis.

11. The device according to claim 1, wherein the float has a decreasing cross section in a downward direction with respect to its longitudinal axis.

12. The device according to claim 1, wherein the filter is in fluid communication with the interior of the chamber through a check valve; the check valve is configured to allow the passage of the oil phase from the filter to the interior of the chamber and prevent the passage of the oil phase from the interior of the chamber to the filter.

13. The device according to claim 1, wherein the float is attached to the chamber by means of a threaded joint.

14. The device according to claim 1, wherein the at least two hoses connected to the upper part of the chamber form a helicoid or spiral to ensure correct elongation of the hoses.

15. The device according to claim 1, wherein the at least two hoses are at least partly welded together.

16. The device according to claim 1, wherein the at least two hoses are made of an oil phase resistant polymer.

17. A device for separating an oil phase from an aqueous phase in a remediation well and conveying said separated oil phase to a tank located outside of the remediation well, wherein said device comprises:

a chamber comprising at least two hoses connected to an upper part of the chamber, the hoses being in fluid communication with an interior of the chamber;

an oil phase and aqueous phase separating filter located in the upper part of the chamber, the filter being in fluid communication with the interior of the chamber and having a lid on an upper part of the filter; and a hollow float attached to a lower part of the chamber, the float comprising a ballast at a lower end thereof, wherein the ballast comprises a centering body at a lower end thereof, wherein the at least two hoses are at least partly welded together.

18. A device for separating an oil phase from an aqueous phase in a remediation well and conveying said separated oil phase to a tank located outside of the remediation well, wherein said device comprises:

a chamber comprising at least two hoses connected to an upper part of the chamber, the hoses being in fluid communication with an interior of the chamber;

an oil phase and aqueous phase separating filter located in the upper part of the chamber, the filter being in fluid communication with the interior of the chamber and having a lid on an upper part of the filter; and a hollow float attached to a lower part of the chamber, the float comprising a ballast at a lower end thereof, wherein the ballast comprises a centering body at a lower end thereof, wherein the chamber has an increasing cross section in a downward direction with respect to its longitudinal axis.

19. A device for separating an oil phase from an aqueous phase in a remediation well and conveying said separated oil phase to a tank located outside of the remediation well, wherein said device comprises:

a chamber comprising at least two hoses connected to an upper part of the chamber, the hoses being in fluid communication with an interior of the chamber;

an oil phase and aqueous phase separating filter located in the upper part of the chamber, the filter being in fluid communication with the interior of the chamber and having a lid on an upper part of the filter; and a hollow float attached to a lower part of the chamber, the float comprising a ballast at a lower end thereof, wherein the ballast comprises a centering body at a lower end thereof, wherein the filter has a decreasing cross section in a downward direction with respect to its longitudinal axis.

* * * * *